US011458521B2

(12) United States Patent
Yamamoto et al.

(10) Patent No.: US 11,458,521 B2
(45) Date of Patent: Oct. 4, 2022

(54) MANUFACTURING DEVICE FOR BENT PIPE AND METHOD OF MANUFACTURING BENT PIPE

(71) Applicant: FUTABA INDUSTRIAL CO., LTD., Okazaki (JP)

(72) Inventors: Koichiro Yamamoto, Okazaki (JP); Hiro Iwase, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

(21) Appl. No.: 17/172,588

(22) Filed: Feb. 10, 2021

(65) Prior Publication Data

US 2021/0316351 A1 Oct. 14, 2021

(30) Foreign Application Priority Data

Apr. 13, 2020 (JP) ..... JP2020-071656

(51) Int. Cl.
*B21D 9/05* (2006.01)

(52) U.S. Cl.
CPC ..... *B21D 9/05* (2013.01)

(58) Field of Classification Search
CPC . B21D 9/01; B21D 9/05; B21D 9/073; B21D 9/16; B21D 11/07; B21C 3/16; B21C 37/15; B21B 17/02
See application file for complete search history.

(56) References Cited

U.S. PATENT DOCUMENTS 5,214,950 A * 6/1993 Grobbenhaar ..... B21D 9/073 72/370.01
5,937,686 A * 8/1999 Arai ..... B21D 9/073 72/370.01

FOREIGN PATENT DOCUMENTS

DE 3415077 C1 * 9/1985
JP S60234723 A 11/1985
JP 2007319904 A 12/2007

* cited by examiner

*Primary Examiner* — Teresa M Ekiert
(74) *Attorney, Agent, or Firm* — Withrow & Terranova, P.L.L.C.; Vincent K. Gustafson

(57) ABSTRACT

One aspect of the present disclosure is a manufacturing device for a bent pipe. The manufacturing device includes an inner core metal placed inside a first pipe, and a tubular intermediate core metal placed between the first pipe and a second pipe. The intermediate core metal includes an intermediate core metal main body and a tubular first intermediate movable portion. The first intermediate movable portion is coupled to an end portion of the intermediate core metal main body, and swings about a first intermediate pivot axis relative to the intermediate core metal main body. The intermediate core metal main body includes an edge positioned closer to the first intermediate movable portion while the double pipe is bent. The edge intersects an imaginary plane orthogonal to a central axis of the second pipe at a position where the second pipe contacts the intermediate core metal.

5 Claims, 10 Drawing Sheets

MANUFACTURING DEVICE FOR BENT PIPE AND METHOD OF MANUFACTURING BENT PIPE

CROSS-REFERENCE TO RELATED APPLICATIONS

This application claims the benefit of Japanese Patent Application No. 2020-71656 filed on Apr. 13, 2020 with the Japan Patent Office, the disclosure of which is incorporated herein by reference.

BACKGROUND

The present disclosure relates to a manufacturing device for a bent pipe and a method of manufacturing a bent pipe.

There has been known a method for producing a bent pipe by externally pressing a bending mold against a double pipe containing a core metal (i.e. a mandrel) (see Japanese Unexamined Patent Application Publication No. S60-234723). An intermediate core metal arranged between an inner pipe and an outer pipe of the double pipe includes a core metal body and a movable portion swingably coupled to the core metal body.

In the above method, the movable portion of the intermediate core metal moves so as to follow the pipe during bending a pipe to form a bending shape of the pipe.

SUMMARY

In the bending process using the above-described core metal, an inner side of the inner pipe is compressed in an axial direction by the core metal body and the movable portion. Therefore, the compression in the axial direction of the pipe tends to cause buckling (i.e. a wrinkle) in the inner pipe.

In one aspect of the present disclosure, it is preferable that a manufacturing device for a bent pipe is provided that enables reduction in buckling when a double pipe is bent.

One aspect of the present disclosure is a manufacturing device for a bent pipe, by which the bent pipe is obtained by bending a double pipe with a first pipe and a second pipe. The second pipe contains therein the first pipe. The manufacturing device for a bent pipe comprises an inner core metal configured to be placed inside the first pipe, an intermediate core metal configured to be placed between the first pipe and the second pipe, and a bending mold configured to bend the double pipe, in which the inner core metal and the intermediate core metal are placed.

The intermediate core metal comprises an intermediate core metal main body and a first intermediate movable portion. The intermediate core metal main body has a tubular shape. The first intermediate movable portion has a tubular shape and is configured to be coupled to an end portion of the intermediate core metal main body in an axial direction of the intermediate core metal main body, and to swing about a first intermediate pivot axis relative to the intermediate core metal main body. The first intermediate pivot axis is orthogonal to a central axis of the intermediate core metal main body. The intermediate core metal main body comprises a first proximate portion. The first proximate portion includes an edge positioned closer to the first intermediate movable portion while the double pipe is bent with the bending mold. The edge of the first proximate portion intersects an imaginary plane orthogonal to a central axis of the second pipe at a position where the second pipe contacts the intermediate core metal.

With such a configuration, the edge of the first proximate portion of the intermediate core metal main body is formed so as to be non-parallel to a circumferential direction of the double pipe. Thus, an axially compressive force that is generated at an inner side of the bend of the first pipe when the first pipe is pressed by the intermediate core metal main body and the first intermediate movable portion is distributed in the circumferential direction of the first pipe. Consequently, buckling generated when the double pipe is bent is inhibited in the first pipe.

In one embodiment of the present disclosure, the first proximate portion may protrude toward the first intermediate movable portion in the axial direction of the intermediate core metal main body. With such a configuration, the first proximate portion of the intermediate core metal main body presses a portion where the buckling is generated in the first pipe while the double pipe is being bent. This enables generation of the buckling to be inhibited more accurately.

In one embodiment of the present disclosure, the first proximate portion may have a width in a circumferential direction of the intermediate core metal main body. The width may become smaller toward a protruding end of the first proximate portion. With such a configuration, the first proximate portion increases an effect of distributing the compressive forces. Consequently, a reducing effect on generation of the buckling is enhanced.

In one embodiment of the present disclosure, the intermediate core metal may further comprise a second intermediate movable portion having a tubular shape and configured to be coupled to the first intermediate movable portion on an opposite side of the intermediate core metal main body across the first intermediate movable portion. The second intermediate movable portion may swing about a second intermediate pivot axis relative to the first intermediate movable portion. The second intermediate pivot axis may be orthogonal to a central axis of the first intermediate movable portion. The first intermediate movable portion may comprise a second proximate portion. The second proximate portion may include an edge positioned closer to the second intermediate movable portion while the double pipe is bent with the bending mold. The edge of the second proximate portion may intersect an imaginary plane orthogonal to the central axis of the second pipe at a position where the second pipe contacts the intermediate core metal. Such a configuration enables buckling generated when manufacturing a bent pipe with a large bending radius to be accurately inhibited.

Another aspect of the present disclosure is a method of manufacturing a bent pipe, by which the bent pipe is obtained by bending a double pipe with a first pipe and a second pipe. The second pipe contains therein the first pipe. The method of manufacturing a bent pipe comprises: placing an inner core metal inside the first pipe, and placing an intermediate core metal between the first pipe and the second pipe; and bending the double pipe, in which the inner core metal and the intermediate core metal are placed.

The intermediate core metal comprises an intermediate core metal main body and a first intermediate movable portion. The intermediate core metal main body has a tubular shape. The first intermediate movable portion has a tubular shape and is configured to be coupled to an end portion of the intermediate core metal main body in an axial direction of the intermediate core metal main body, and to swing about a first intermediate pivot axis relative to the intermediate core metal main body. The first intermediate pivot axis is orthogonal to a central axis of the intermediate core metal main body. The intermediate core metal main body comprises a first proximate portion. The first proximate portion includes an edge positioned closer to the first intermediate movable portion while the double pipe is bent. The edge of the first proximate portion intersects an imaginary plane orthogonal to a central axis of the second pipe at a position where the second pipe contacts the intermediate core metal.

With such a configuration, an axially compressive force generated at an inner side of the bend of the first pipe is distributed in a circumferential direction. Consequently, the buckling generated when the double pipe is bent is inhibited in the first pipe.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. First Embodiment

[1-1. Configuration]

Figure 1:
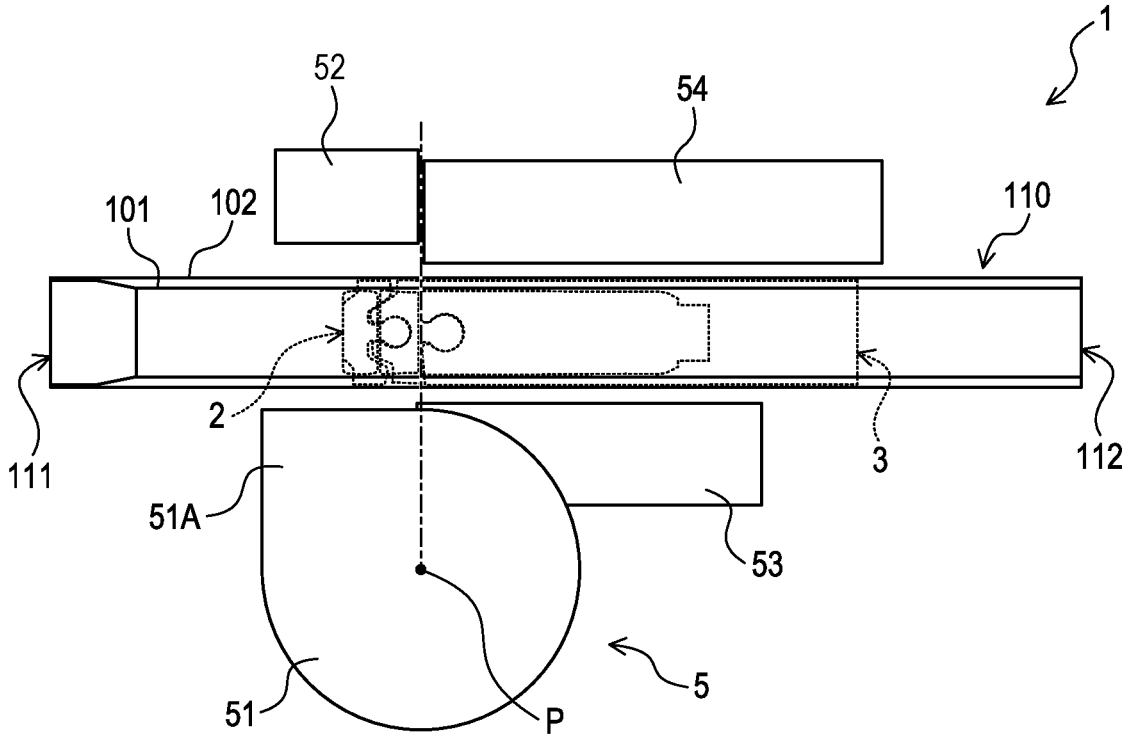
FIG. 1 is a schematic diagram of a manufacturing device for a bent pipe of an embodiment.

A device 1 for manufacturing a bent pipe (hereinafter, simply referred to as "manufacturing device 1") shown in FIG. 1 is a device for obtaining a bent pipe by bending a straight pipe.

The manufacturing device 1 of the present embodiment manufactures a bent pipe from a double pipe 110 that comprises a first pipe 101 and a second pipe 102. The second pipe 102 is placed to enclose an outer-circumferential surface of the first pipe 101. In other words, the second pipe 102 contains therein the first pipe 101.

The first pipe 101 and the second pipe 102 are joined to each other at a first end 111 of the double pipe 110. At a second end 112 situated opposite to the first end 111, however, the first pipe 101 and the second pipe 102 are not joined to each other.

The first pipe 101 and the second pipe 102 each have a circular outer shape in a cross-section orthogonal to respective central axes of the first pipe 101 and the second pipe 102. In the present embodiment, the central axis of the first pipe 101 and the central axis of the second pipe 102 coincide with each other; however, the respective central axes of the first pipe 101 and the second pipe 102 need not coincide with each other.

The manufacturing device 1 simultaneously bends the first pipe 101 and the second pipe 102 while leaving a gap therebetween, to thereby obtain the bent double pipe 110 as the bent pipe.

The manufacturing device 1 comprises an inner core metal 2, an intermediate core metal 3, and a bending mold 5.

<Inner Core Metal>

Figure 2A:
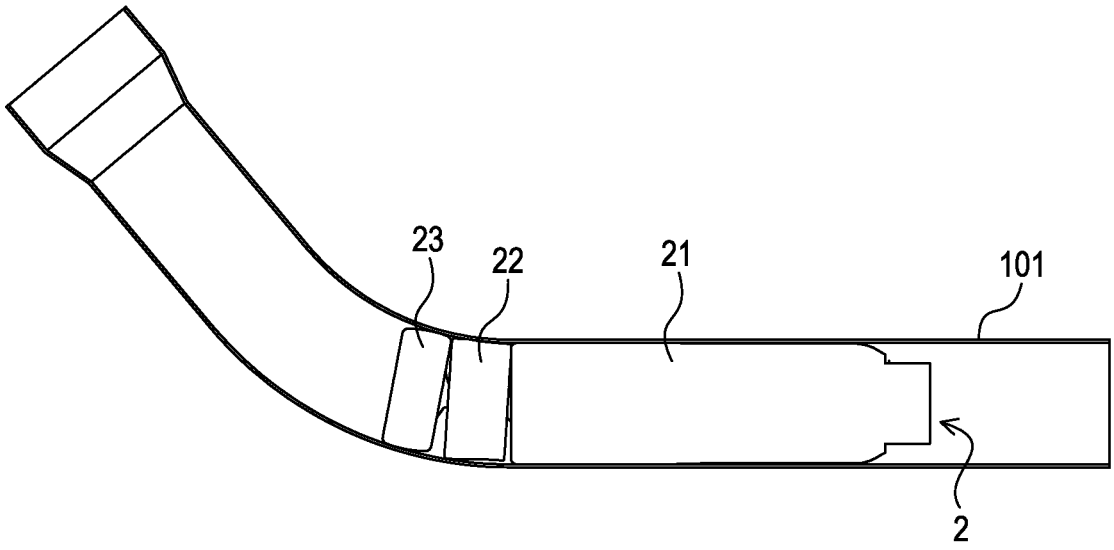
FIG. 2A is a schematic side view of an inner core metal of the manufacturing device for a bent pipe in FIG. 1.
Figure 2B:
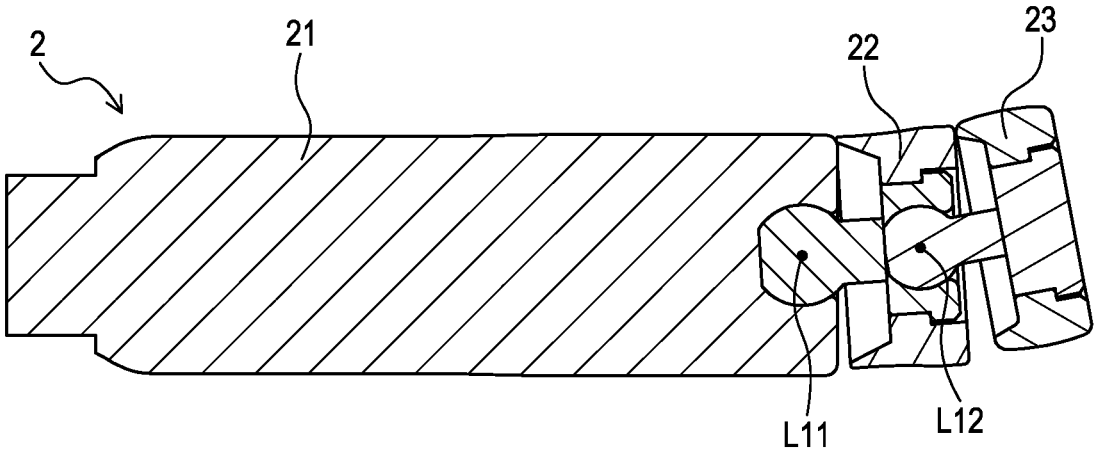
FIG. 2B is a center sectional view of the inner core metal in FIG. 2A.

As shown in FIG. 2A, the inner core metal 2 is configured to be placed inside the first pipe 101. As shown in FIG. 2B, the inner core metal 2 includes an inner core metal main body 21, a first inner movable portion 22, and a second inner movable portion 23.

(Inner Core Metal Main Body)

The inner core metal main body 21 comprises a cylindrical or columnar member. The inner core metal main body 21 is placed in a straight portion (in other words, a portion that is not bent) of the double pipe 110.

An outer diameter of the inner core metal main body 21 is constant along an axial direction thereof. The outer diameter of the inner core metal main body 21 is substantially equal to an inner diameter of the first pipe 101. A length of the inner core metal main body 21 along the axial direction is longer than respective lengths of the first inner movable portion 22 and the second inner movable portion 23 along the axial direction.

(First Inner Movable Portion)

The first inner movable portion 22 comprises a cylindrical or columnar member that is coupled to one end of the inner core metal main body 21 in the axial direction.

The first inner movable portion 22 swings about a first inner pivot axis L11 relative to the inner core metal main body 21. The first inner pivot axis L11 is orthogonal to the central axis of the inner core metal main body 21. The first inner pivot axis L11 passes through a point of intersection of a straight line including the central axis of the inner core metal main body 21 and a straight line including the central axis of the first inner movable portion 22.

The first inner movable portion 22 is partially held in the inner core metal main body 21. The first inner pivot axis L11 is positioned inside the inner core metal main body 21.

(Second Inner Movable Portion)

The second inner movable portion 23 comprises a cylindrical or columnar member that is coupled to the first inner movable portion 22 on the opposite side of the inner core metal main body 21 across the first inner movable portion 22.

The second inner movable portion 23 swings about a second inner pivot axis L12 relative to the first inner movable portion 22. The second inner pivot axis L12 is parallel to the first inner pivot axis L11 of the first inner movable portion 22. The second inner pivot axis L12 passes through a point of intersection of the straight line including the central axis of the first inner movable portion 22 and a straight line including the central axis of the second inner movable portion 23.

The second inner movable portion 23 is partially held in the first inner movable portion 22. The second inner pivot axis L12 is positioned inside the first inner movable portion 22.

<Intermediate Core Metal>

The intermediate core metal 3 shown in FIG. 1 is configured to be placed between the first pipe 101 and the second pipe 102.

The intermediate core metal 3 is placed in a bending portion of the double pipe 110 so as to interpose the first pipe 101 between the intermediate core metal 3 and the inner core metal main body 21 in a radial direction of the first pipe 101. Furthermore, the intermediate core metal 3 is interposed between the first pipe 101 and the second pipe 102 in the radial direction of the first pipe 101.

Figure 3A:
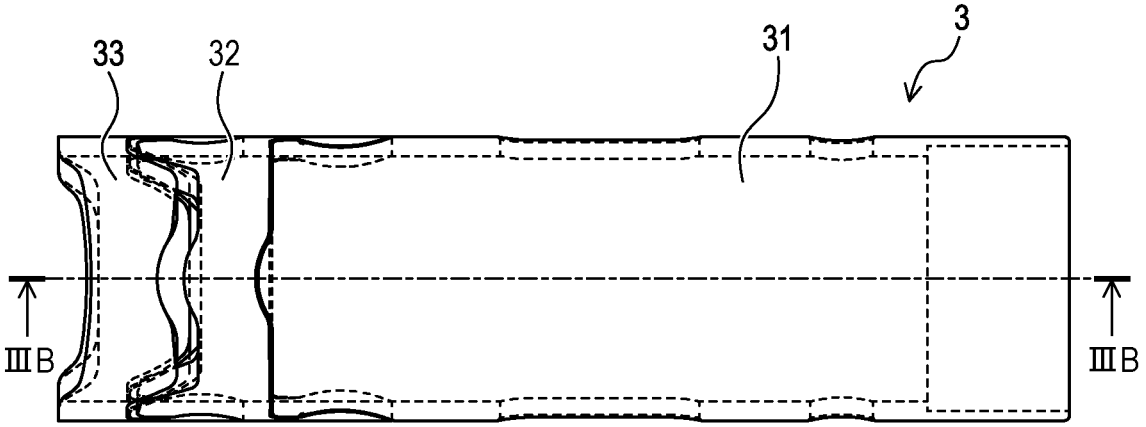
FIG. 3A is a schematic plan view of an intermediate core metal of the manufacturing device for a bent pipe in FIG. 2A.
Figure 3B:
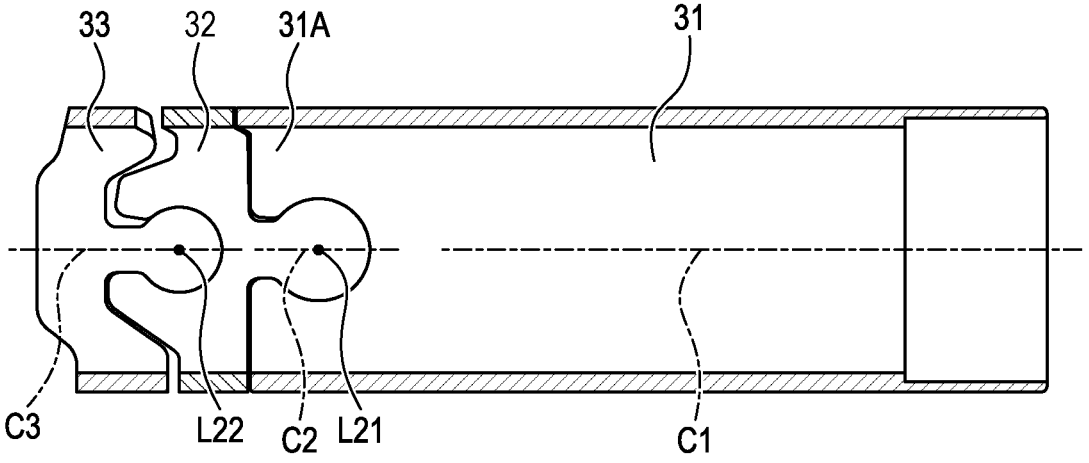
FIG. 3B is a schematic sectional view taken along line IIIB-IIIB in FIG. 3A.

As shown in FIGS. 3A and 3B, the intermediate core metal 3 includes an intermediate core metal main body 31, a first intermediate movable portion 32, and a second intermediate movable portion 33.

(Intermediate Core Metal Main Body)

Figure 4A:
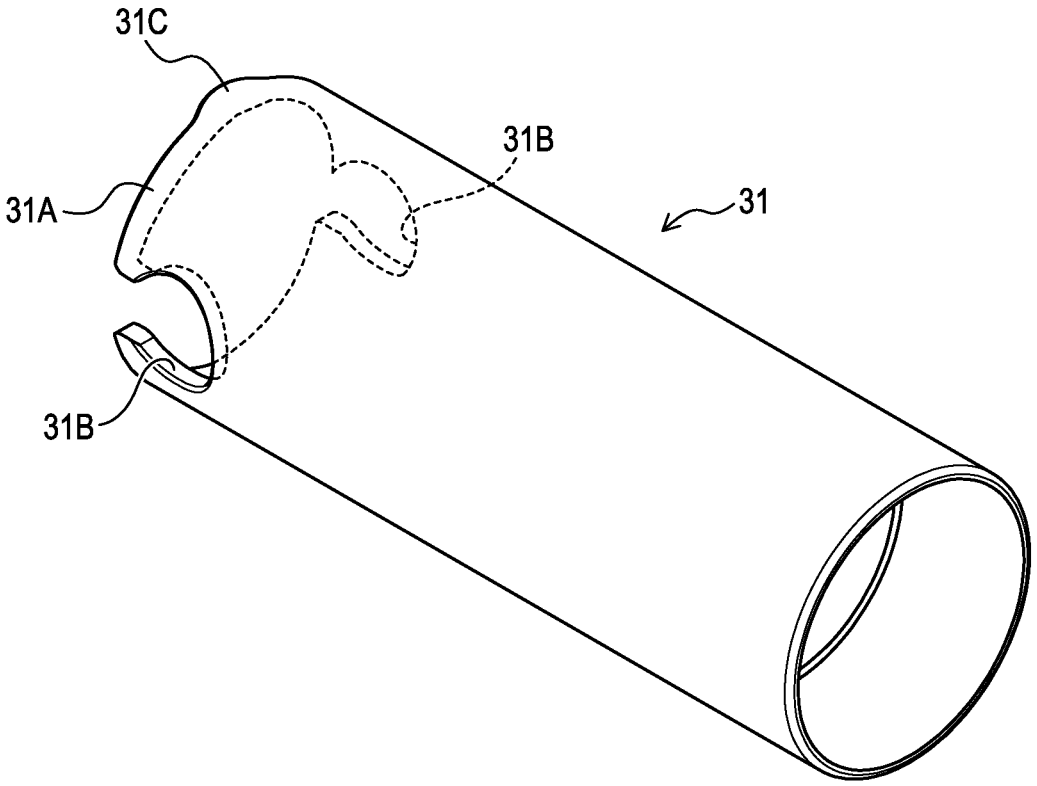
FIG. 4A is a schematic perspective view of an intermediate core metal main body of the intermediate core metal in FIG. 3A.

As shown in FIG. 4A, the intermediate core metal main body 31 comprises a cylindrical member. The intermediate core metal main body 31 is placed in the straight portion of the double pipe 110.

An inner diameter and an outer diameter of the intermediate core metal main body 31 are constant along an axial direction thereof. The inner diameter of the intermediate core metal main body 31 is substantially equal to the outer diameter of the first pipe 101. The outer diameter of the intermediate core metal main body 31 is substantially equal to the inner diameter of the second pipe 102. A length of the intermediate core metal main body 31 along the axial direction is longer than respective lengths of the first intermediate movable portion 32 and the second intermediate movable portion 33 along the axial direction.

The intermediate core metal main body 31 includes two engagement receiving portions 31B provided in the first end portion 31A. The first end portion 31A is one end of the intermediate core metal main body 31 in the axial direction. The engagement receiving portion 31B is a notch recessed inward in the axial direction of the intermediate core metal main body 31.

Figure 4B:
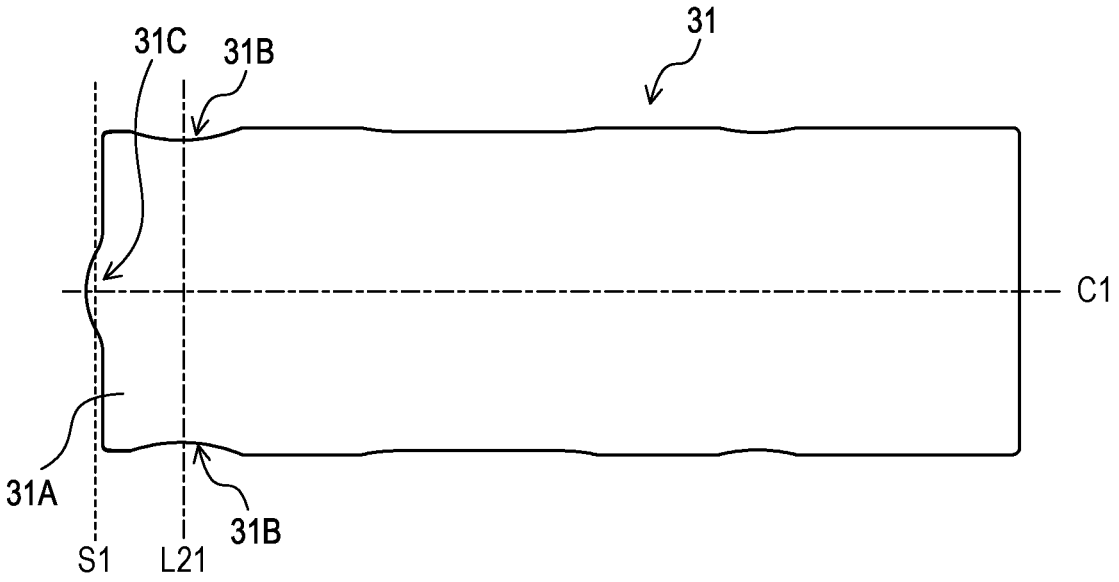
FIG. 4B is a schematic plan view of the intermediate core metal main body in FIG. 4A.

As shown in FIG. 4B, the intermediate core metal main body 31 includes a first proximate portion 31C. An edge of the first proximate portion 31C is positioned closer to the first intermediate movable portion 32 while the double pipe 110 is being bent with the bending mold 5. The edge of the first proximate portion 31C intersects an imaginary plane S1 orthogonal to the central axis of the second pipe 102 (that is, the central axis C1 of the intermediate core metal main body 31) at a position where the second pipe 102 contacts the first proximate portion 31C.

Specifically, the first proximate portion 31C is a part of the first end portion 31A. The first proximate portion 31C overlaps the central axis C1 of the intermediate core metal main body 31, as viewed from a direction orthogonal to the central axis C1 of the intermediate core metal main body 31 and to a first intermediate pivot axis L21, which will be described below. The first proximate portion 31C is positioned on an inner side (i.e., concave side) of the bend while the double pipe 110 is being bent.

The first proximate portion 31C is a tongue-shaped portion protruding toward the first intermediate movable portion 32 in the axial direction of the intermediate core metal main body 31. The first proximate portion 31C protrudes most in the first end portion 31A in the axial direction. Further, the first proximate portion 31C has a width in a circumferential direction of the intermediate core metal main body 31. The width gradually becomes smaller toward a protruding end of the first proximate portion 31C (that is, smaller as being closer to the first intermediate movable portion 32). The edge of the first proximate portion 31C has a curved shape like connected arcs.

(First Intermediate Movable Portion)

The first intermediate movable portion 32 shown in FIG. 3B is a cylindrical member that is directly coupled to the first end portion 31A of the intermediate core metal main body 31.

The first intermediate movable portion 32 swings about the first intermediate pivot axis L21 relative to the intermediate core metal main body 31. The first intermediate pivot axis L21 is orthogonal to the central axis C1 of the intermediate core metal main body 31. The first intermediate pivot axis L21 passes through a point of intersection of a straight line including the central axis C1 of the intermediate core metal main body 31 and of a straight line including the central axis C2 of the first intermediate movable portion 32.

Figure 5A:
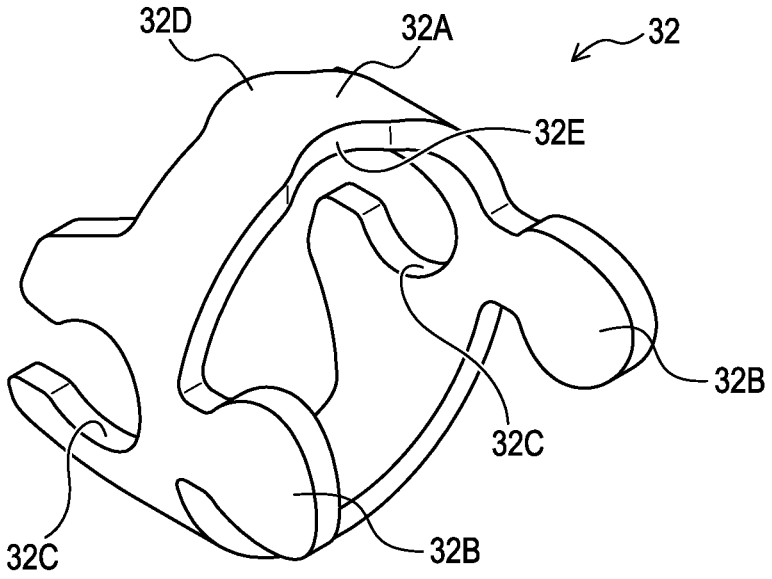
FIG. 5A is a schematic perspective view of a first intermediate movable portion of the intermediate core metal in FIG. 3A.

As shown in FIG. 5A, the first intermediate movable portion 32 includes a ring portion 32A, two engagement portions 32B, and two engagement receiving portions 32C. The ring portion 32A has an inner diameter and an outer diameter that are constant in an axial direction of the first intermediate movable portion 32.

The two engagement portions 32B each protrude toward the intermediate core metal main body 31 from the ring portion 32A. The two engagement portions 32B face to each other in a radial direction of the first intermediate movable portion 32. The two engagement portions 32B are each swingably engaged with the engagement receiving portion 31B of the intermediate core metal main body 31.

The two engagement receiving portions 32C are each arranged on the opposite side of the end having the engagement portion 32B of the ring portion 32A. The engagement receiving portion 32C is a notch recessed inward in the axial direction of the first intermediate movable portion 32.

Figure 5B:
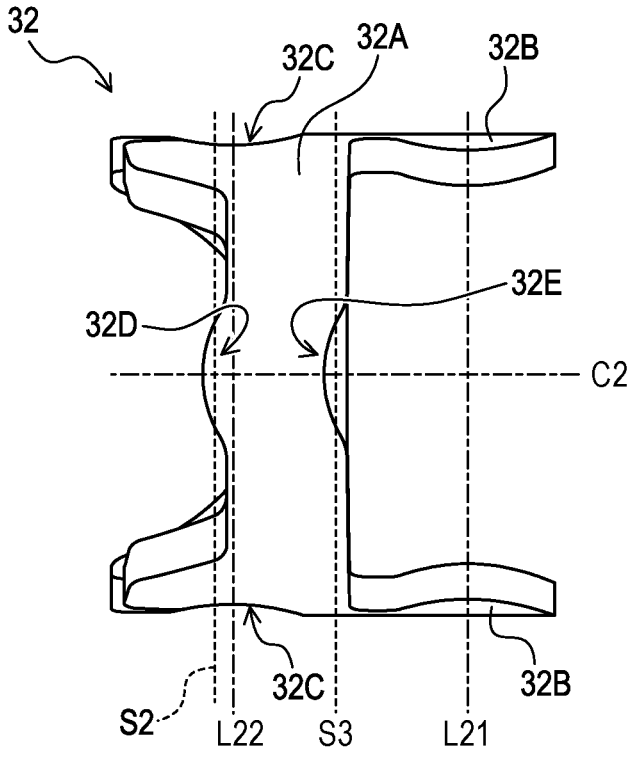
FIG. 5B is a schematic plan view of the first intermediate movable portion in FIG. 5A.

As shown in FIG. 5B, the first intermediate movable portion 32 includes a second proximate portion 32D. An edge of the second proximate portion 32D is positioned closer to the second intermediate movable portion 33 while the double pipe 110 is being bent with the bending mold 5. The edge of the second proximate portion 32D intersects an imaginary plane S2 orthogonal to the central axis of the second pipe 102 (that is, the central axis C2 of the first intermediate movable portion 32) at a position where the second pipe 102 contacts the second proximate portion 32D.

Specifically, the second proximate portion 32D is a part of the end of the ring portion 32A where the engagement receiving portions 32C are provided. The second proximate portion 32D overlaps the central axis C2 of the first intermediate movable portion 32, as viewed from a direction orthogonal to the central axis C2 of the first intermediate movable portion 32 and to a second intermediate pivot axis L22, which will be described below. The second proximate portion 32D is positioned on the inner side of the bend while the double pipe 110 is being bent.

The second proximate portion 32D is a tongue-shaped portion protruding toward the second intermediate movable portion 33 in the axial direction of the first intermediate movable portion 32. Further, the second proximate portion 32D has a width in a circumferential direction of the first intermediate movable portion 32. The width gradually becomes smaller toward a protruding end of the second proximate portion 32D (that is, smaller as being closer to the second intermediate movable portion 33). The edge of the second proximate portion 32D has a curved shape like connected arcs.

The first intermediate movable portion 32 includes a third proximate portion 32E. An edge of the third proximate portion 32E is positioned closer to the first proximate portion 31C of the intermediate core metal main body 31 while the double pipe 110 is being bent with the bending mold 5. The edge of the third proximate portion 32E intersects an imaginary plane S3 orthogonal to the central axis of the second pipe 102 at a position where the second pipe 102 contacts the third proximate portion 32E.

Specifically, the third proximate portion 32E is a part of an end of the ring portion 32A where the engaging portions 32B are provided. The third proximate portion 32E overlaps the central axis C2 of the first intermediate movable portion 32, as viewed from a direction orthogonal to the first intermediate pivot axis L21 and to the central axis C2 of the first intermediate movable portion 32. The third proximate portion 32E is positioned on the inner side of the bend while the double pipe 110 is being bent.

The third proximate portion 32E is recessed in the axial direction of the first intermediate movable portion 32 so as to be away from the intermediate core metal main body 31. Further, the recess of the third proximate portion 32E has a width in the circumferential direction of the first intermediate movable portion 32. The width gradually decreases with an increase in the distance in the axial direction of the first intermediate movable portion 32 from the intermediate core metal main body 31. The edge of the third proximate portion 32E has a curved shape like connected arcs.

The third proximate portion 32E has a shape that neither abuts on the first proximate portion 31C, nor allows a gap between the third proximate portion 32E and the first proximate portion 31C to be greater while the double pipe 110 is being bent. The edge of the third proximate portion 32E has a substantially similar shape to that of the first proximate portion 31C.

(Second Intermediate Movable Portion)

The second intermediate movable portion 33 shown in FIG. 3B is a cylindrical member that is directly coupled to the first intermediate movable portion 32 on an opposite side of the intermediate core metal main body 31 across the first intermediate movable portion 32.

The second intermediate movable portion 33 swings about the second intermediate pivot axis L22 relative to the first intermediate movable portion 32. The second intermediate pivot axis L22 is parallel to the first intermediate pivot axis L21 of the first intermediate movable portion 32. The second intermediate pivot axis L22 passes through a point of intersection of a straight line including the central axis C2 of the first intermediate movable portion 32 and of a straight line including the central axis C3 of the second intermediate movable portion 33.

Figure 6A:
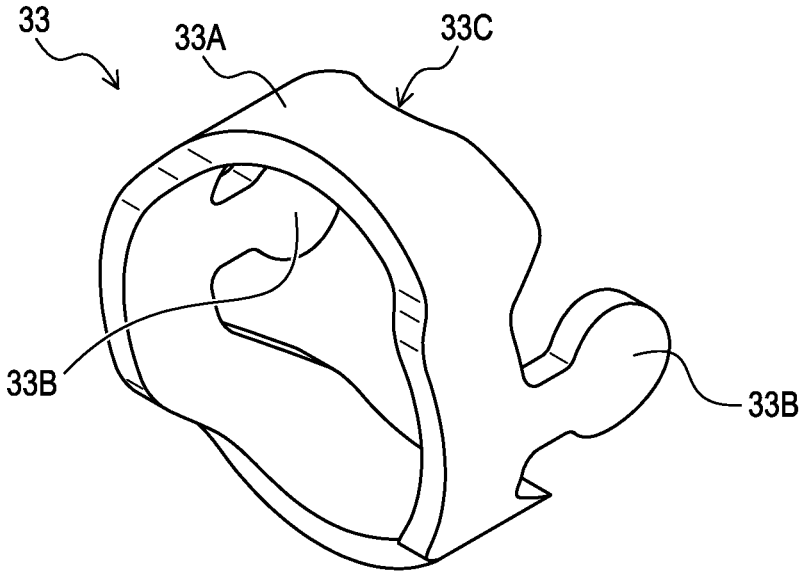
FIG. 6A is a schematic perspective view of a second intermediate movable portion of the intermediate core metal in FIG. 3A.
Figure 6B:
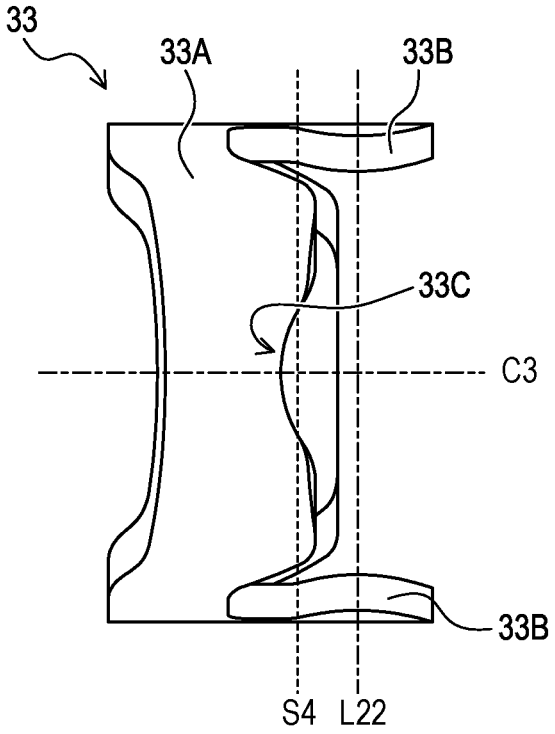
FIG. 6B is a schematic plan view of the second intermediate movable portion in FIG. 6A.

As shown in FIG. 6A, the second intermediate movable portion 33 includes a ring portion 33A and two engaging portions 33B. The ring portion 33A has an inner diameter and an outer diameter that are constant along an axial direction of the second intermediate movable portion 33.

The two engagement portions 33B each protrude toward the first intermediate movable portion 32 from the ring portion 33A. The two engagement portions 33B face to each other in a radial direction of the second intermediate movable portion 33. The two engagement portions 33B are each swingably engaged with the engagement receiving portion 32C arranged on an end of the first intermediate movable portion 32.

The second intermediate movable portion 33 includes a fourth proximate portion 33C. An edge of the fourth proximate portion 33C is positioned closer to the second proximate portion 32D of the first intermediate movable portion 32 while the double pipe 110 is being bent with the bending mold 5. The edge of the fourth proximate portion 33C intersects an imaginary plane S4 orthogonal to the central axis of the second pipe 102 (that is, the central axis C3 of the second intermediate movable portion 33) at a position where the second pipe 102 contacts the fourth proximate portion 33C.

Specifically, the fourth proximate portion 33C is a part of the end of the ring portion 33A where the engaging portions 33B are provided. The fourth proximate portion 33C overlaps the central axis C3 of the second intermediate movable portion 33, as viewed from a direction orthogonal to the second intermediate pivot axis L22 and to the central axis C3 of the second intermediate movable portion 33. The fourth proximate portion 33C is positioned on the inner side of the bend while the double pipe 110 is being bent.

The fourth proximate portion 33C is recessed in the axial direction of the second intermediate movable portion 33 so as to be away from the first intermediate movable portion 32. Further, the recess of the fourth proximate portion 33C has a width in the circumferential direction of the second intermediate movable portion 33. The width gradually decreases with an increase in the distance in the axial direction of the second intermediate movable portion 33 from the first intermediate movable portion 32. The edge of the fourth proximate portion 33C has a curved shape like connected arcs.

The fourth proximate portion 33C has a shape that neither abuts on the second proximate portion 32D, nor allows a gap between the fourth proximate portion 33C and the second proximate portion 32D to be greater while the double pipe 110 is being bent. The edge of the fourth proximate portion 33C has a substantially similar shape to that of the second proximate portion 32D.

<Bending Mold>

The bending mold 5 shown in FIG. 1 is configured to bend the double pipe 110 in an area of the double pipe 110 where the inner core metal 2 and the intermediate core metal 3 are placed.

Specifically, the bending mold 5 rotates and moves while interposing the first pipe 101 and the second pipe 102 between the bending mold 5, the inner core metal 2, and the intermediate core metal 3 in the radial direction, to thereby bend the first pipe 101 and the second pipe 102. The bending mold 5 includes a rotating portion 51, a clamping portion 52, a slider 53, and a forwarding portion 54.

The rotating portion 51 is placed radially outside the bending portion of the double pipe 110. The rotating portion 51 is configured to rotate about a rotation axis P with a chuck portion 51A pressed against an outer-circumferential surface of the double pipe 110. The rotation axis P of the rotating portion 51 is parallel to the first inner pivot axis L11 of the first inner movable portion 22.

The rotating portion 51 is configured to press an inner surface of the first pipe 101 against the first inner movable portion 22 and the second inner movable portion 23, and also to press an inner surface of the second pipe 102 against the first intermediate movable portion 32 and the second intermediate movable portion 33.

The clamping portion 52 is located opposite to the rotating portion 51 across the double pipe 110. The clamping portion 52 is configured to hold the double pipe 110 between the clamping portion 52 and the chuck portion 51A of the rotating portion 51. The clamping portion 52 swings about the rotation axis P of the rotating portion 51 as a result of rotation of the rotating portion 51.

The slider 53 is placed adjacent to the rotating portion 51. In the bending process, the slider 53 slides along an outer-circumference surface of the straight portion of the double pipe 110, to thereby exhibit a guiding function to forward the double pipe 110 along a rotation direction of the rotating portion 51.

The forwarding portion 54 is located at a position that is opposite to the slider 53 across the double pipe 110 and is adjacent to the clamping portion 52. The forwarding portion 54 is configured to move along the central axis of the double pipe 110 while pressing the straight portion of the double pipe 110 in the radial direction. The forwarding portion 54 forwards the double pipe 110 toward the rotating portion 51 while pressing the double pipe 110 against the slider 53.

[1-2. Manufacturing Method]

Figure 7:
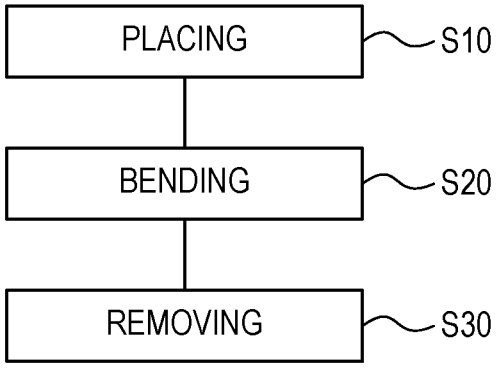
FIG. 7 is a flowchart of a method of manufacturing a bent pipe of an embodiment.

Hereinafter, descriptions are given to a method of manufacturing a bent pipe using the manufacturing device 1 for a bent pipe shown in FIG. 1. As shown in FIG. 7, the method of manufacturing a bent pipe of the present embodiment comprises placing S10, bending S20, and removing S30.

<Placing>

In the placing, the inner core metal 2 is placed inside the first pipe 101 and the intermediate core metal 3 is placed between the first pipe 101 and the second pipe 102. Specifically, the double pipe 110 is introduced in the axial direction toward the inner core metal 2 and the intermediate core metal 3 that are held between the rotating portion 51 and the clamping portion 52 of the bending mold 5.

In this placing, the inner core metal 2 is held such that the respective central axes of the inner core metal main body 21, the first inner movable portion 22, and the second inner movable portion 23 coincide with each other. Similarly, the intermediate core metal 3 is held such that the respective central axes of the intermediate core metal main body 31, the first intermediate movable portion 32, and the second intermediate movable portion 33 coincide with each other.

Further, the first inner movable portion 22 is placed so as to overlap the intermediate core metal 3 in the radial direction of the first pipe 101. The second inner movable portion 23 is placed such that at least part of the second inner movable portion 23 overlaps the intermediate core metal 3 in the radial direction of the first pipe 101.

<Bending>

In bending, the first pipe 101 and the second pipe 102 are bent by the bending mold 5 in an area of the double pipe 110 where the inner core metal 2 and the intermediate core metal 3 are placed.

Figure 8A:
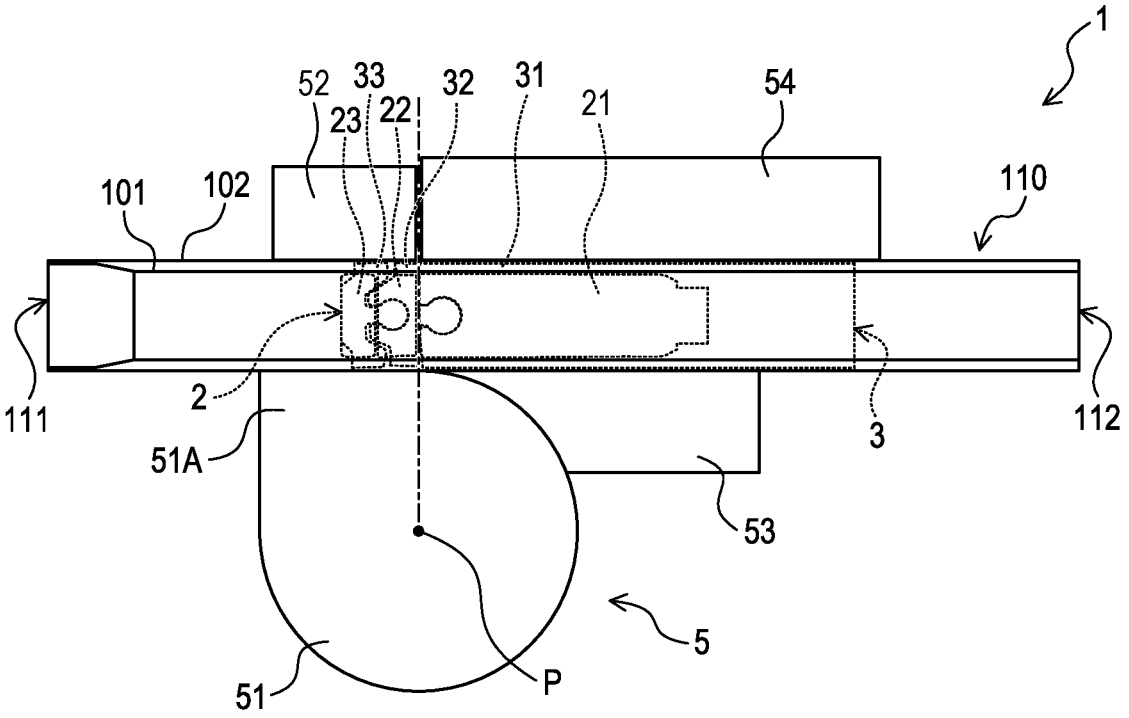
FIG. 8A is a schematic diagram illustrating a procedure of the method of manufacturing a bent pipe in FIG. 7.

Specifically, as shown in FIG. 8A, the clamping portion 52 and the forwarding portion 54 apply pressure, in the radial direction, to the double pipe 110 that contains the inner core metal 2 and the intermediate core metal 3 therein. As a result, the double pipe 110 slides toward the rotating portion 51 in the radial direction together with the inner core metal 2 and the intermediate core metal 3. The double pipe 110 is pressed against the chuck portion 51A of the rotating portion 51 by the clamping portion 52 and is also pressed against the slider 53 by the forwarding portion 54.

Figure 8B:
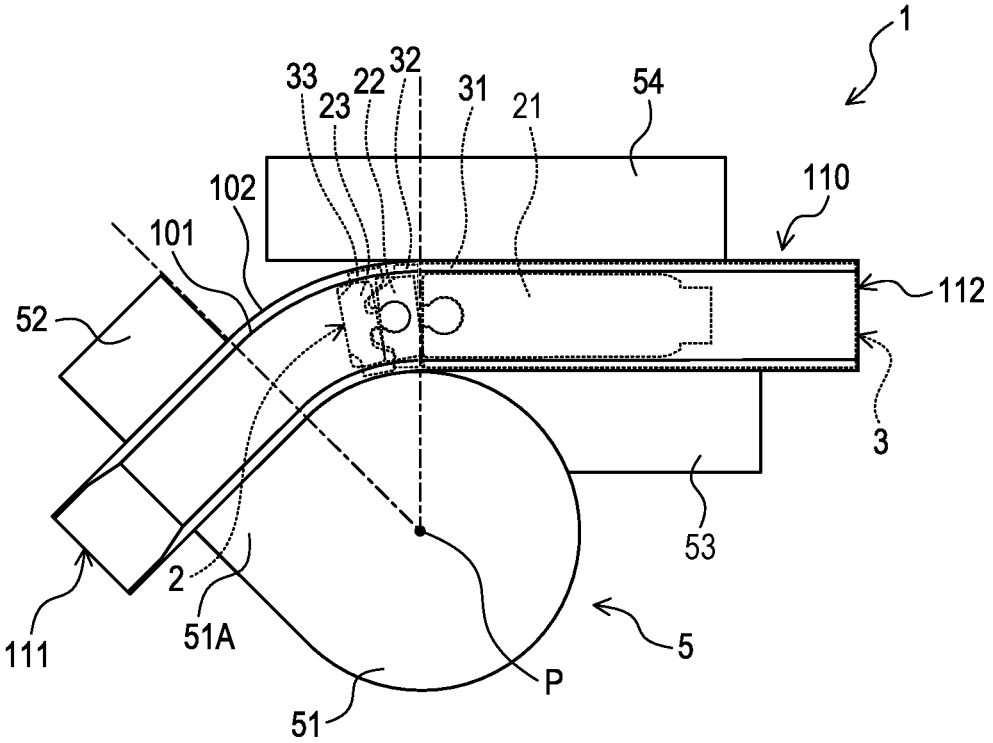
FIG. 8B is a schematic diagram illustrating a procedure next to the procedure in FIG. 8A.

Subsequently, as shown in FIG. 8B, the rotating portion 51 rotates in a direction in which the chuck portion 51A is spaced apart from the slider 53 (that is, toward the first end 111) and the forwarding portion 54 slides in a direction to follow the clamping portion 52.

Due to the above-described rotation and sliding, the chuck portion 51A and the clamping portion 52 slide on the outer-circumferential surface of the double pipe 110 toward the first end 111 while interposing the double pipe 110 therebetween. Consequently, a portion of the double pipe 110, which is interposed between the chuck portion 51A and the clamping portion 52, is plastically deformed to curve about the rotation axis P1 of the rotating portion 51.

The first inner movable portion 22 swings relative to the inner core metal main body 21 to correspond to the bending of the double pipe 110 resulting from the rotation of the rotating portion 51. Similarly, the second inner movable portion 23 swings relative to the first inner movable portion 22 to correspond to the bending of the double pipe 110 resulting from the rotation of the rotating portion 51.

In accordance with the bending of the double pipe 110 by the rotation of the rotating portion 51, the first intermediate movable portion 32 and the second intermediate movable portion 33 each swing so as not to generate a gap therebetween in the axial direction in the inner side of the bend. In other words, the first intermediate movable portion 32 and the second intermediate movable portion 33 each move inside the curved second pipe 102 to a position where the gap is eliminated or reduced in an area facing an outer surface of the first pipe 101 in the inner side of the bend.

The inner core metal main body 21 and the intermediate core metal main body 31 are held not to move during the bending. Accordingly, the double pipe 110 moves, extending in a movement direction of the clamping portion 52, while sliding with respect to the inner core metal 2 and the intermediate core metal 3.

<Removing>

In removing, the double pipe 110 is removed from the inner core metal 2, the intermediate core metal 3, and the bending mold 5 after the bending.

Figure 9A:
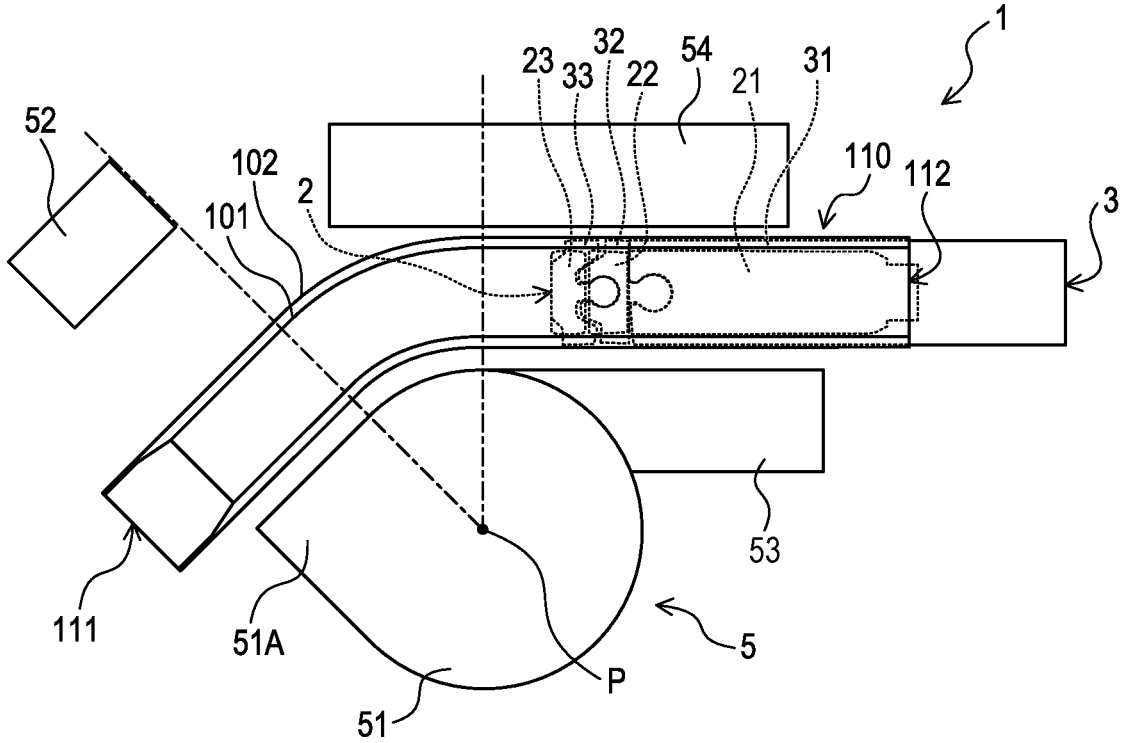
FIG. 9A is a schematic diagram illustrating a procedure next to the procedure in FIG. 8B.

Specifically, as shown in FIG. 9A, the inner core metal 2 and the intermediate core metal 3 first return back to respective positions where the bending portion of the double pipe 110 is not overlapped with the inner core metal 2 and the intermediate core metal 3. Next, the clamping portion 52 and the forwarding portion 54 are spaced apart from the double pipe 110 in the radial direction and the double pipe 110 is spaced apart from the rotating portion 51 and also the slider 53.

Figure 9B:
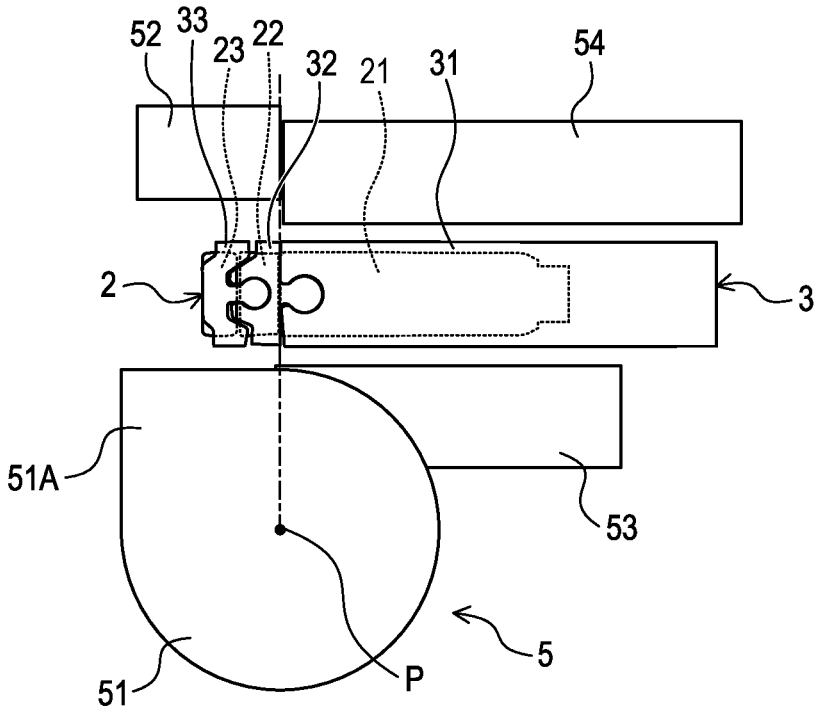
FIG. 9B is a schematic diagram illustrating a procedure next to the procedure in FIG. 9A.
Figure 10A:
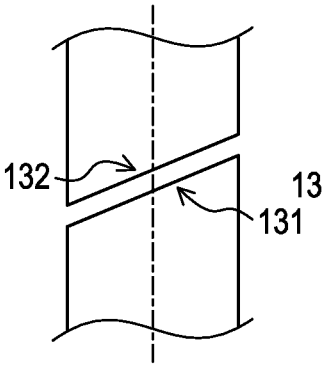
FIGS. 10A to 10K are schematic diagrams showing various types of a proximate portion of other embodiments than the one shown in FIG. 3A.
Figure 10B:
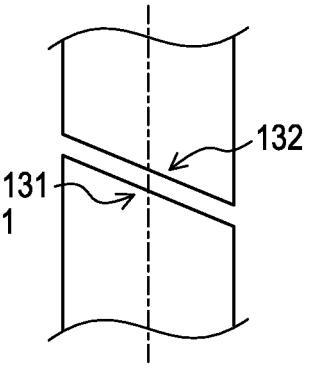
Figure 10C:
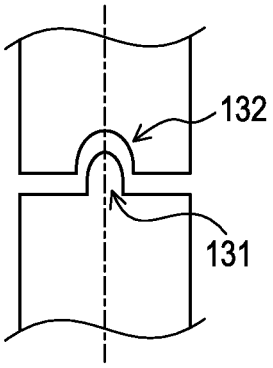
Figure 10D:
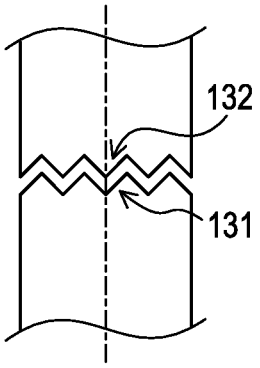
Figure 10E:
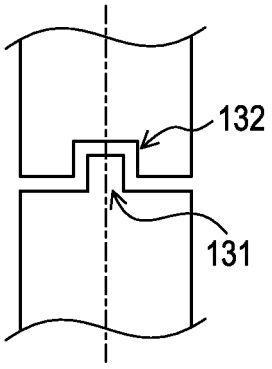
Figure 10F:
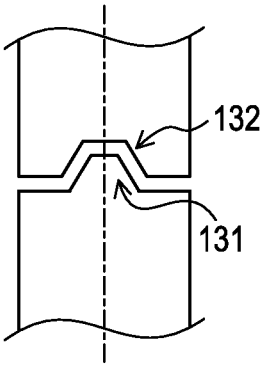
Figure 10G:
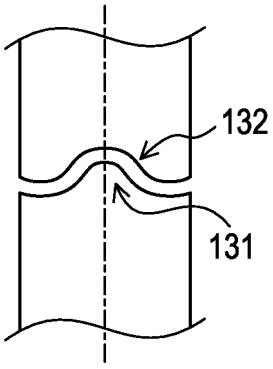
Figure 10H:
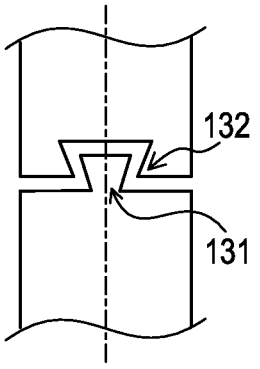
Figure 10I:
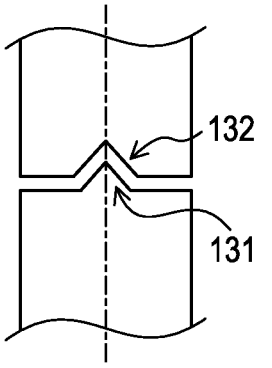
Figure 10J:
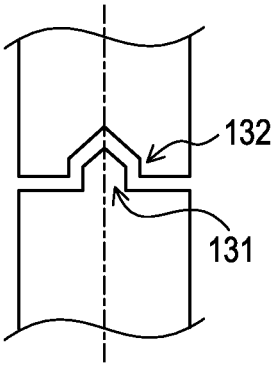
Figure 10K:
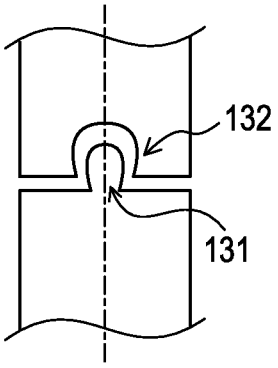

Lastly, as shown in FIG. 9B, the inner core metal 2, the intermediate core metal 3, and the bending mold 5 are returned to an initial position (that is, a position allowing the double pipe 110 to be introduced before the bending).

[1-3. Effect]

According to the above-detailed embodiment, the following effect can be obtained.

(1a) The edge of the first proximate portion 31C of the intermediate core metal main body 31 is formed so as to be non-parallel to a circumferential direction of the double pipe 110. Thus, the axially compressive force that is generated at the inner side of the bend of the first pipe 101 when the first pipe 101 is pressed by the intermediate core metal main body 31 and the first intermediate movable portion 32 is distributed in the circumferential direction of the first pipe 101. Consequently, buckling generated when the double pipe 110 is bent is inhibited in the first pipe 101.

(1b) The first proximate portion 31C of the intermediate core metal main body 31 protrudes toward the first intermediate movable portion 32 to press a portion where the buckling is generated in the first pipe 101 while the double pipe 110 is being bent. This enables generation of the buckling to be inhibited more accurately.

(1c) The width of the first proximate portion 31C in the circumferential direction of the intermediate core metal main body 31 becomes smaller toward the protruding end, thereby increasing an effect of distributing the compressive forces. Consequently, a reducing effect on generation of the buckling is enhanced.

(1d) The intermediate core metal 3 includes the second intermediate movable portion 33, and further the edge of the second proximate portion 32D of the second intermediate movable portion 33 intersects the imaginary plane orthogonal to the central axis of the second pipe 102 at a position where the edge of the second proximate portion 32D contacts the intermediate core metal 3. This enables the buckling generated when manufacturing a bent pipe with a large bending radius to be accurately inhibited.

2. Other Embodiments

The embodiments of the present disclosure have been described above; however, it is to be understood that the present disclosure is not limited to the above-described embodiments but may be practiced in various forms.

(2a) In the manufacturing device for a bent pipe according to the aforementioned embodiment, the first proximate portion need not necessarily have the width that is smaller toward its protruding end. Further, the first proximate portion need not necessarily protrude toward the first intermediate movable portion. The same applies to the second proximate portion.

For example, shapes of a proximate portion 131 as shown in FIGS. 10A-10K may be employed as that of the first proximate portion or the second proximate portion. Further, shapes of a proximate portion 132 as shown in FIGS. 10A-10K may be employed as that of the third proximate portion or the fourth proximate portion.

(2b) In the manufacturing device for a bent pipe according to the aforementioned embodiment, the inner core metal may include one inner movable portion, or three or more inner movable portions. Further, the intermediate core metal may include one intermediate movable portion, or three or more intermediate movable portions.

(2c) Functions of one element of the above-described embodiments may be distributed to a plurality of elements. Functions of a plurality of elements may be performed by one element. Part of the configurations of the above-described embodiments may be omitted. At least part of the configurations of the above-described embodiments may be added to or replaced with the configurations of the other above-described embodiments. Any embodiment included in the technical ideas defined by the language of the claims is an embodiment of the present disclosure.

What is claimed is:

1. A manufacturing device for a bent pipe, by which the bent pipe is obtained by bending a double pipe comprising a first pipe and a second pipe, the second pipe containing therein the first pipe, the manufacturing device comprising:

an inner core metal configured to be placed inside the first pipe;

an intermediate core metal configured to be placed between the first pipe and the second pipe; and a bending mold configured to bend the double pipe, in which the inner core metal and the intermediate core metal are placed, wherein the intermediate core metal comprises:

an intermediate core metal main body having a tubular shape; and a first intermediate movable portion having a tubular shape and configured to be coupled to an end portion of the intermediate core metal main body in an axial direction of the intermediate core metal main body, and to swing about a first intermediate pivot axis relative to the intermediate core metal main body, the first intermediate pivot axis being orthogonal to a central axis of the intermediate core metal main body, wherein the intermediate core metal main body comprises a first proximate portion, the first proximate portion including an edge positioned closer to the first intermediate movable portion while the double pipe is bent with the bending mold, the edge of the first proximate portion including a first protrusion that protrudes, relative to a remainder of the edge of the first proximate portion, in the axial direction of the intermediate core metal main body toward the first intermediate movable portion.

2. The manufacturing device for a bent pipe according to claim 1, wherein the first proximate portion has a width in a circumferential direction of the intermediate core metal main body, the width becoming smaller toward a protruding end of the first proximate portion.

3. The manufacturing device for a bent pipe according to claim 1, wherein the intermediate core metal further comprises a second intermediate movable portion having a tubular shape, the second intermediate movable portion being configured to be coupled to the first intermediate movable portion on an opposite side of the intermediate core metal main body across the first intermediate movable portion, the second intermediate movable portion swinging about a second intermediate pivot axis relative to the first intermediate movable portion, the second intermediate pivot axis being orthogonal to a central axis of the first intermediate movable portion, and wherein the first intermediate movable portion comprises a second proximate portion, the second proximate portion including an edge positioned closer to the second intermediate movable portion while the double pipe is bent with the bending mold, the edge of the second proximate portion including a second protrusion that protrudes, relative to a remainder of the edge of the second proximate portion, in the axial direction of the intermediate core metal main body toward the second intermediate movable portion.

4. A method of manufacturing a bent pipe, by which the bent pipe is obtained by bending a double pipe comprising a first pipe and a second pipe, the second pipe containing therein the first pipe, the method comprising:

placing an inner core metal inside the first pipe, and placing an intermediate core metal between the first pipe and the second pipe; and bending the double pipe, in which the inner core metal and the intermediate core metal are placed, wherein the intermediate core metal comprises:

an intermediate core metal main body having a tubular shape; and, a first intermediate movable portion having a tubular shape and configured to be coupled to an end portion of the intermediate core metal main body in an axial direction of the intermediate core metal main body, and to swing about a first intermediate pivot axis relative to the intermediate core metal main body, the first intermediate pivot axis being orthogonal to a central axis of the intermediate core metal main body, and wherein the intermediate core metal main body comprises a first proximate portion, the first proximate portion including an edge positioned closer to the first intermediate movable portion while the double pipe is bent, the edge of the first proximate portion including a first protrusion that protrudes, relative to a remainder of the edge of the first proximate portion, in the axial direction of the intermediate core metal main body toward the first intermediate movable portion.

5. The method of manufacturing a bent pipe according to claim 4, wherein the intermediate core metal further comprises a second intermediate movable portion having a tubular shape, the second intermediate movable portion being configured to be coupled to the first intermediate movable portion on an opposite side of the intermediate core metal main body across the first intermediate movable portion, the second intermediate movable portion swinging about a second intermediate pivot axis relative to the first intermediate movable portion, the second intermediate pivot axis being orthogonal to a central axis of the first intermediate movable portion, and wherein the first intermediate movable portion comprises a second proximate portion, the second proximate portion including an edge positioned closer to the second intermediate movable portion while the double pipe is bent with the bending mold, the edge of the second proximate portion including a second protrusion that protrudes, relative to a remainder of the edge of the second proximate portion, in the axial direction of the intermediate core metal main body toward the second intermediate movable portion.

* * * * *